US005431017A

United States Patent [19]

Kobayashi et al.

[11] Patent Number: 5,431,017

[45] Date of Patent: Jul. 11, 1995

[54] COMBUSTOR FOR GAS TURBINE SYSTEM HAVING A HEAT EXCHANGING STRUCTURE CATALYST

[75] Inventors: Tadashi kobayashi, Chigasaki; Masahiko Yamada, Tokyo, both of Japan

[73] Assignee: Kabushiki Kaisha Toshiba, Kawasaki, Japan

[21] Appl. No.: 194,345

[22] Filed: Feb. 8, 1994

[30] Foreign Application Priority Data

Feb. 8, 1993 [JP] Japan ..... 5-020342

[51] Int. Cl.[6] ..... F02C 1/00

[52] U.S. Cl. ..... 60/723; 431/7; 431/170

[58] Field of Search ..... 60/723, 39.06; 431/7, 431/11, 170, 243

[56] References Cited

U.S. PATENT DOCUMENTS 4,731,989 3/1988 Furuya et al. ..... 60/723
5,000,004 3/1991 Yamanaka et al. ..... 60/723
5,161,366 11/1992 Beebe .

FOREIGN PATENT DOCUMENTS 0179730 10/1983 Japan ..... 60/723
0126333 6/1986 Japan ..... 60/723

*Primary Examiner*—Richard A. Bertsch
*Assistant Examiner*—William Wicker
*Attorney, Agent, or Firm*—Oblon, Spivak, McClelland, Maier & Neustadt

[57] ABSTRACT

A combustor for a gas turbine utilizing a catalytic combustion system comprises a cylindrical outer casing, a combustion cylinder concentrically disposed inside the outer casing with an annular space between an outer periphery of the combustion cylinder and an inner periphery of the outer casing as a combustion air supply passage, the combustion cylinder having one end facing the closed one end of the casing with a space therebetween, and a catalyst unit disposed inside the combustion cylinder, the air for combustion being supplied to the catalyst unit. A heat exchanging device is formed in the air supply passage for heating the combustion air passing the air supply passage to a temperature more than a catalytic combustion starting temperature through a heat exchanging operation by a thermal energy of a combustion gas in the combustion cylinder. The combustion cylinder includes at least one section chamber for combustion and the catalyst unit is disposed in the section chamber and includes a plurality of catalyst sections sectioned in a plane normal to a flow direction of the air for combustion introduced into the combustion cylinder. The combustion cylinder is provided with a plurality of diffuse combustion zones and a plurality of premixture combustion zones are formed at the downstream side of the catalyst unit.

14 Claims, 8 Drawing Sheets

COMBUSTOR FOR GAS TURBINE SYSTEM HAVING A HEAT EXCHANGING STRUCTURE CATALYST

BACKGROUND OF THE INVENTION

The present invention relates to a combustor for a gas turbine system utilized for a compound cycle power plant, and more particularly, to a combustor for a catalytic combustion type gas turbine system.

In these days, in a view point of an effective utilization of an energy source, various types of gas-turbine/-steam-turbine compound cycle power plants have been adapted. Such power plants, however, involve significant problems or objects of reducing nitrogen oxide (NOx) discharged from the power plants particularly in the view point of an environmental protection.

Such a conventional compound cycle power plant includes a homogeneous type combustion system in which an air/fuel mixture is ignited by a spark plug means, for example. However, in a combustor for such a conventional gas turbine, a highly heated (high temperature of more than 2000° C.) portion is locally caused in the combustor at the time of fuel burning, nitrogen ($N_2$) decomposed from air in atmosphere is combined with oxygen ($O_2$), and thus, a large amount of NOx is generated, also providing a significant problem.

In the prior art, there is further studied and developed various combustion systems for solving such problems, and in recent years, there is provided a catalytic combustion system utilizing a solid phase catalyst.

FIG. 9 is a schematic diagram representing one example of such a conventional combustor utilizing the catalytic combustion system. Referring to FIG. 9, the combustor includes a cylindrical casing 1 and a combustion cylinder (heating cylinder) 2 coaxially arranged inside the casing 1. The combustion cylinder 2 has one end wall, lefthand end as viewed, separated from one end wall of the casing to define a gap therebetween. An annular circumferential space is also defined between the inner combustion cylinder 2 and the outer casing 1, and the gap and the space are communicated with each other so as to form a combustion air supply passage 3.

The end wall, i.e. lefthand end wall, of the combustion cylinder 2 has a central portion at which a nozzle 4 for a diffuse fuel (diffuse fuel nozzle 4) is disposed and a swirler 5 is arranged around the outer peripheral portion of the diffuse fuel nozzle 4. A catalyst unit 6 in which a catalyst for the combustion of honeycomb structure utilizing a solid phase catalyst is located in the combustion cylinder 2, and a mixture gas supply port 8, through which a mixture gas of a fuel for the catalytic combustion (catalytic combustion fuel) supplied through a nozzle 7 for the catalyst (catalyst fuel nozzle 7) and an air for combustion is supplied, is formed on an upstream side, facing the diffuse fuel nozzle 4 in the illustration, of the catalyst unit 6.

On the downstream side of the catalyst unit 6 in the combustion cylinder 2, there is formed a nozzle 9 for a premixture fuel (premixture fuel nozzle 9), and an enlarged zone or portion 10 is also formed further on the downstream side of the premixture fuel nozzle 9 for uniformly mixing the mixture gas. A rear, righthand end as viewed in FIG. 9, of the enlarged portion 10 is connected to a turbine nozzle, not shown. The mixture gas is burned by means of ignition plugs 11 and 12 having ignition points positioned in the mixture gas supply port 8 and the enlarged portion 10 in the combustion cylinder.

The fuel is classified into or composed of a fuel for diffuse combustion (diffuse combustion fuel) F1, a fuel for calalytic combustion (catalytic combustion fuel) F2 and a fuel for premixture combustion (premixture combustion fuel) F3, which are supplied into the combustion cylinder 2 respectively through the diffuse fuel nozzle 4, the catalyst fuel nozzle 7 and the premixture fuel nozzle 9. On the other hand, air for combustion (combustion air) is supplied into the combustion air supply passage 3 through a front end opening of the passage 3 as shown by an arrow in FIG. 9, and then supplied into the combustion cylinder 2 in part through the swirler 5 and in remaining part together with the catalytic combustion fuel F2 through the supply port 8. The combustion gas subsequently burned in the cylinder 2 is jetted into a gas turbine through the turbine nozzle connected to the enlarged portion 10 at the rear end of the combustion cylinder 2.

FIG. 10 is a graph showing a relationship between a fuel flow rate and a combustor load in connection with a fuel rate control, in which the abscissa axis represents a combustor load and the ordinate axis represents a fuel flow rate.

With reference to FIG. 10, an ignition is carried out at the point Pa, and the diffuse combustion fuel F1 from the diffuse fuel nozzle 4 and the premixture combustion fuel F3 from the premixture fuel nozzle 9 are supplied into the combustion cylinder 2 up to the time when the combustor load reaches the point Pe. When the combustor load exceeds the point Pe, a condition for causing the catalytic combustion is realized (for example, a temperature at the inlet portion of the catalyst unit reaches a predetermined temperature), so that the catalytic combustion fuel F2 is supplied into the combustion cylinder 2 through the catalyst fuel nozzle 7 to then carry out the combustion in the catalyst unit 6 and to adjust the flow rate of the diffuse combustion fuel F1 so as to maintain an optimum gas temperature at an inlet of the catalyst unit 6. A curve B in FIG. 10 represents a change of a total fuel flow rate. As shown in FIG. 10, at the combustor load more than point Pe, almost half the fuel can be burned through the catalytic combustion, thus suppressing the generation of NOx.

FIG. 11 represents a temperature change of the gas temperature at the inlet portion of the catalyst unit 6 with respect to the combustor load.

However, the above-mentioned catalytic combustion system involves such problem as requires an increased temperature more than a predetermined one for starting the catalytic combustion. It is required at present for the catalytic combustion starting temperature to be higher than a temperature of the combustion air to be supplied with respect to almost catalysts, of course, being different in accordance with kinds or types of catalysts and fuels to be utilized. Accordingly, it is necessary to increase the temperature of the air/fuel mixture gas to be supplied to the catalyst unit up to the catalytic combustion starting temperature. For this purpose, the diffuse combustion is to be performed with respect to a part of the fuel.

In such method, the diffuse combustion provides a stable combustion, but has a high burning temperature, which results in generation of the NOx. The NOx generated during this diffuse combustion process constitutes almost part of the NOx generated in the entire combustor. Accordingly, this method provides a NOx suppression effect more than that of the conventional combustor utilizing no catalytic combustion system. However, as stated above, this method is not applicable for a present or future combustor to which more severe NOx prescription will be required.

SUMMARY OF THE INVENTION

An object of the present invention is to substantially eliminate defects or drawbacks encountered in the prior art described above and to provide a gas turbine combustor utilizing a catalytic combustion system capable of effectively suppressing the generation of nitrogen oxide (NOx).

This and other objects can be achieved according to the present invention by providing a combustor for a gas turbine utilizing a catalytic combustion system comprising:

a cylindrical outer casing having one closed end and another opened end;

a combustion cylinder concentrically disposed inside the outer casing with an annular space between an outer periphery of the combustion cylinder and an inner periphery of the outer casing as an air supply passage for an air for combustion from a compressor, the combustor cylinder having one end facing the closed one end of the casing with a space therebetween and another opened end projecting outward through the opened end of the casing, the air supply passage being communicated with the space between the facing ends of the casing and the combustion cylinder;

a catalyst unit disposed inside the combustion cylinder, the air for combustion being supplied to the catalyst unit; and a heat exchanging means formed in the air supply passage for heating the air for combustion passing the air supply passage to a temperature more than a catalytic combustion starting temperature through a heat exchanging operation by a thermal energy of a combustion gas in the combustion cylinder.

In preferred embodiments, the heat exchanging means is formed on an outer periphery of a main combustion chamber of the combustion cylinder and an inner periphery of the casing as protruding members such as fins, for example, projecting from the outer and inner peripheries.

The combustion cylinder includes at least one section chamber for combustion and the catalyst unit is disposed in the section chamber and includes a plurality of catalyst sections sectioned in a plane normal to a flow direction of the air for combustion introduced into the combustion cylinder and a fuel flow rate control means is disposed for controlling independently flow rates of fuel supplied to the respective catalyst sections in accordance with a load of the combustor. The combustion cylinder includes a plurality of section chambers in each of which a catalyst unit is disposed.

The combustion cylinder is provided with a plurality of diffuse combustion zones, and a plurality of premixture combustion zones are formed on a downstream side the catalyst unit with respect to the flow of the combustion air and a fuel flow rate control means is disposed for controlling independently flow rates of fuel supplied to the respective diffuse combustion zones and premixture combustion zones in accordance with a load of the combustor. The combustion cylinder includes a plurality of section chambers to which the diffuse combustion zones and the premixture combustion zones are respectively formed.

In another aspect, the heat exchanging means is formed by openings formed to a cylindrical wall of the casing through which an air for combustion is supplied in the air supply passage and then collides with an outer periphery of a main combustion chamber of the combustion cylinder.

In this aspect, an air for combustion supplied from the compressor is divided into an air portion for combustion to be supplied to the catalyst unit through the air supply passage and another air portion for non-combustion to be supplied into the combustion cylinder and mixed with a combustion gas at the downstream side of the main combustion chamber. An air flow rate of the another air portion is controlled by an air flow rate control valve. The air flow rate control valve is controlled to increase the air for combustion in accordance with a load of the combustor.

According to the characters of the present invention described above, when the temperature in the combustion cylinder exceeds a predetermined temperature, the air for combustion to be introduced into the catalyst disposed in the combustion cylinder is heated to a temperature more than a catalytic combustion starting temperature by the heat exchanging means disposed or formed in the combustion air supply passage. Accordingly, the premixture combustion and catalytic combustion can be started from a time of relatively small combustor load, whereby the premixture combustion can be done at the downstream side of the combustion air with extremely stable condition and, in the catalytic combustion load zone, the supply of the diffuse combustion fuel can be completely stopped. Thus, the generation of NOx can be reduced to a degree almost ignored at a level of the the combustor load more than a predetermined level.

Further natures and features of the present invention will be made clear from the following description with reference to the accompanying drawings.

DESCRIPTION OF THE PREFERRED EMBODIMENTS

Preferred embodiments of the present invention will be described hereunder with reference to the accompanying drawings.

First, with reference to FIGS. 1 to 4, a first embodiment of a gas turbine combustor according to the present invention is described.

Figure 1:
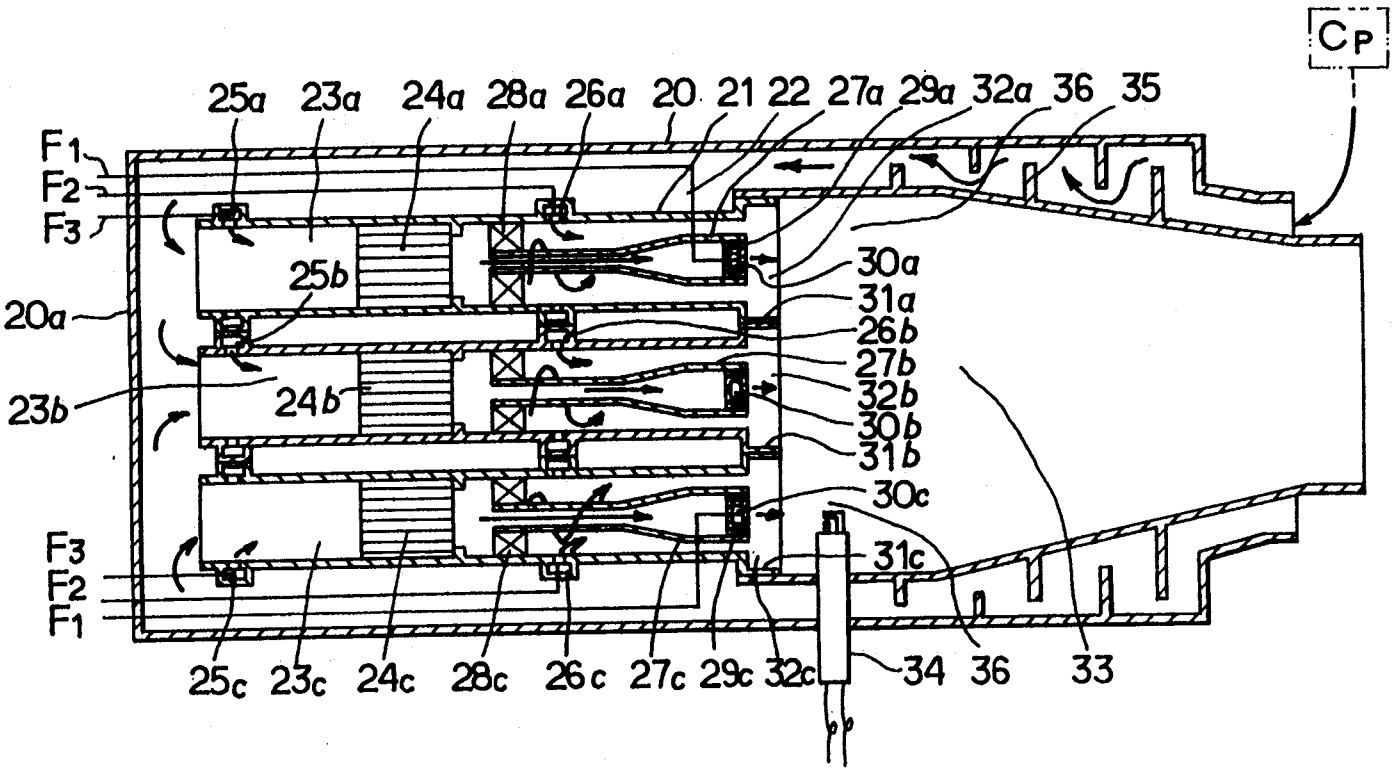
FIG. 1 is a longitudinal section showing one embodiment of a combustor for a gas turbine according to the present invention.

Referring to FIG. 1 showing a longitudinal sectional view of a combustor for a gas turbine, the combustor comprises a cylindrical casing 20 having one end 20*a* closed, lefthand end as viewed, and another opposing end opened. A combustion cylinder (heating cylinder) 21 is disposed in the casing 20 concentrically therewith with an annular gap between the outer periphery of the combustion cylinder 21 and the inner periphery of the casing 20. The combustion cylinder 21 has one end, lefthand end as viewed, separated from the one end 20*a* of the casing 20 with a gap and has another end projecting through the opened end of the casing 20. The projected end of the combustion cylinder is connected to a turbine nozzle, not shown.

An air supply passage 22 for combustion is formed by the gap between end portions of the casing 20 and the combustion cylinder 21 and the annular passage 22 therebetween. An air for combustion supplied by an air compressor Cp, enters the casing 20 through the opened end thereof, righthand end as viewed, passes the air supply passage 22 and then enters the combustion cylinder 21 through one end thereof as shown by arrows in FIG. 1.

In this first embodiment, the combustion cylinder 21 includes a base end portion, on the side facing the closed end of the casing, which is sectioned into a plurality of cylindrical section chambers 23*a*, 23*b* and 23*c* for combustion (three in the illustration) extending in parallel to each other in the axial direction of the combustion cylinder 21. The section chambers 23*a*, 23*b* and 23*c* are provided with catalyst sections 24*a*, 24*b* and 24*c*, respectively, of honeycomb structure, and also provided with catalyst fuel nozzles 25*a*, 25*b* and 25*c* extending in circumferential directions of the respective section chambers 23*a*, 23*b* and 23*c* at portions on the upstream side of the catalyst sections 24*a*, 24*b* and 24*c*, i.e. on the side of the closed end 20*a* of the casing 20. The section chambers 23*a*, 23*b* and 23*c* are further provided with pre-mixture fuel nozzles 26*a*, 26*b* and 26*c* disposed in circumferential directions of the respective section chambers at portions on the downstream side of the catalyst sections 24*a*, 24*b* and 24*c*, respectively.

Cylindrical members 27*a*, 27*b* and 27*c* having widened diameters are disposed inside the section chambers 23*a*, 23*b* and 23*c*, respectively, concentrically therewith at portions at the downstream sides of the catalyst sections 24*a*, 24*b* and 24*c*. Each of the cylindrical members 27*a* (27*b*, 27*c*) has one end facing the catalyst section 24*a* (24*b*, 24*c*) with space and a swirler 28*a* (28*b*, 28*c*) being mounted on the outer periphery of this end portion upstream side with respect to the premixture fuel nozzle 26*a* (26*b*, 26*c*). Each of the cylindrical members 27*a* (27*b*, 27c) also has another end opened at which a diffuse fuel nozzle 30*a* (30*b*, 30*c*) are mounted through a swirler 29*a* (29*b*, 29*c*).

Premixture combustion areas 32*a*, 32*b* and 32*c* are formed at portions in front of and on the downstream side of the opened ends of the cylindrical members 27*a*, 27*b* and 27*c*, respectively, by means of partition walls 31*a*, 31*b* and 31*c* widened in their diameters, and on further downstream sides thereof, there is formed a main combustion chamber or area 33 which is communicated with the respective pre-mixture areas 32*a*, 32*b* and 32*c* and in which an ignition end of the ignition plug 34 projects.

A heat exchanging means 35 is disposed inside the air supply passage 22 between the outer periphery of the main combustion chamber 33 of the combustion cylinder 21 and the inner periphery of the casing 20 for transferring the heat energy of the combustion gas to the air for combustion. The heat exchanging means 35 may be composed of a plurality of fins 35 disposed on the outer periphery of the main combustion chamber 33 and inner periphery of the casing 20 as shown in FIG. 1.

Figure 2:
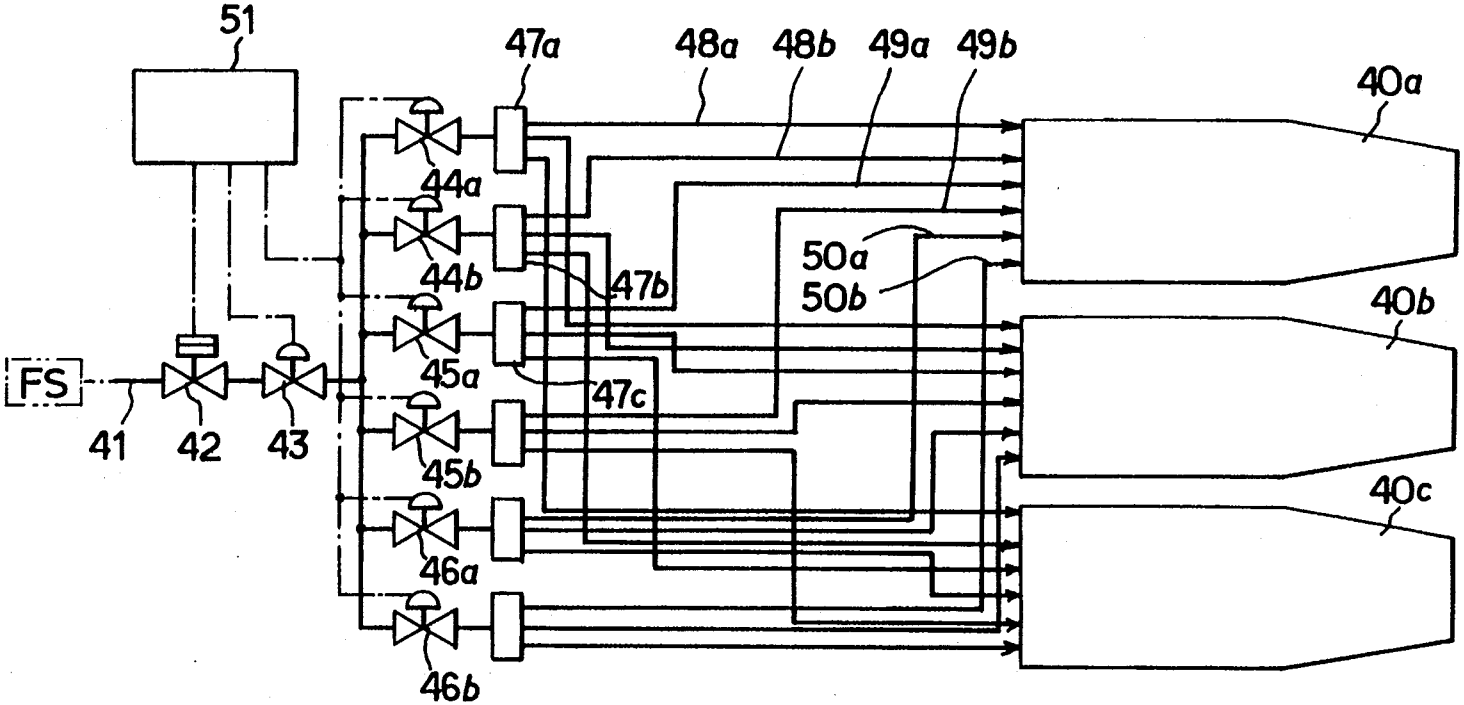
FIG. 2 is a block diagram showing a fuel supply system for the combustor of FIG. 1.

In an actual design of a gas turbine system, a plurality of combustors each shown in FIG. 1 are arranged around the gas turbine and, as shown in FIG. 2, fuel supply lines are connected to the combustors 40*a*, 40*b* and 40*c*, respectively.

That is, with reference to FIG. 2, a fuel supply line 41 led from a fuel supply source FS is equipped with a main fuel check valve 42 and a total fuel flow rate control valve 43, on the downstream side of which catalyst fuel distribution valves 44*a*, 44*b*, - - - , premixture fuel distribution valves 45*a*, 45*b*, - - - , and diffuse fuel distribution valves 46*a*, 46*b*, - - - are arranged, respectively, and headers 47*a*, 47*b*, - - - are disposed on the downstream sides of the respective distribution valves. To the respective headers 47*a*, 47*b*, - - - are connected fuel distribution lines 48*a*, 48*b*, 49*a*, 49*b*, and 50*a*, 50*b*, to which the catalyst fuel nozzles 25*a*, 25*b*, the premixture fuel nozzles 26*a*, 26*b* and the diffuse fuel nozzles 30*a*, 30*b* are connected, respectively.

Loads and temperatures of the respective combustors 40*a*, 40*b* and 40*c* are inputted into a control unit 51 as load setting signals and temperature setting signals. The control valve 43 and the respective distribution valves 44*a*, 45*a*, 46*a*, - - - are controlled by control signals from the control unit 51 so that the degrees of openings of the respective valves are controlled, thereby controlling the fuel flow rate in response to the loads.

When the combustors are operated, a compressor is first driven to supply the air for combustion into the combustion cylinder 21 through the air supply passage 22 in the casing 20, and in association with this operation, a diffuse combustion fuel F1*a* is supplied to a predetermined diffuse fuel nozzle 30*a* and the ignition plug 34 disposed in the main combustion chamber 33 is sparked, thus being ignited. When the ignition is performed, a stable combustion can be continued even if the spark of the ignition plug 34 is stopped because the fuel and air are swirled by means of the swirler 29*a* disposed on the outer periphery of the diffuse fuel nozzle 30*a*. When the temperature in, for example, the main combustion chamber 33 reaches a predetermined temperature through this operation, a diffuse combustion fuel F1*b* is supplied to the next predetermined diffuse fuel nozzle 30*b* and the combustion is carried out.

When the load of the combustor is increased and the temperature in the main combustion chamber 33 reaches a temperature at which the premixture combustion is possibly performed, the premixture combustion fuel F2*a* is supplied to the predetermined premixture fuel nozzle 26*a*. In such operation, the fuel supplied from the premixture fuel nozzle 26*a* and the air flown in to the outer peripheral portion of the cylindrical member 27*a* are subjected to the swirling motion by the swirler 28*a*, and hence, the fuel and air can be flown into the premixture combustion area 32*a* in a well mixed state. At this moment, a flame has already been present in the diffuse combustion area 36 of the main combustion chamber 33, so that the combustion can be hence started in the premixture combustion area 32*a*. As the combustion load increases, the supply amount of the premixture combustion fuel F2*a* is increased and the supply amounts of the diffuse combustion fuels F1*a* and F1*b* are on the contrary decreased.

When the combustion is carried out in the main combustion chamber 33 in the described manner, the thermal energy of the combustion gas in the combustion chamber 33 is transferred to the air for combustion through a heat exchanging operation of the heat exchanging means 35 disposed on the outer periphery of the main combustion chamber 33. The combustion gas can be hence heated and the temperature of the combustion gas at the inlet portion of the catalyst section 24*a* is increased.

In the next process, when the temperature of the combustion gas is increased and a catalytic combustion enabling state is realized, the catalytic combustion fuel F3*a* is supplied to the predetermined catalyst fuel nozzle 25*a*. Then, after the catalytic combustion fuel is mixed with the combustion gas in the section chamber 23*a*, the mixture is guided to the catalyst section 24*a* at which the catalytic combustion is carried out and the combustion gas flows to the downstream side. In this operation, the catalytic combustion fuel flow rate is controlled so that the temperature at the outlet portion of the catalyst means becomes lower than 1000° C. being a heat resistance temperature of the catalyst. This temperature of 1000° C. is a temperature for a catalyst considered to be possibly usable at present days as the catalyst of such combustor system.

When the catalytic combustion is performed, the gas temperature at the catalyst outlet portion becomes high such as about 900° C., and an extremely stable premixture combustion condition can be realized on the downstream side of the catalyst outlet portion. Accordingly, even if the supply of the diffuse combustion fuels F1*a* and F1*b* are completely stopped after the starting of the catalytic combustion, the combustion can be extremely stably maintained only by the catalytic combustion and the premixture combustion. Then, when the combustor load further increases, the catalytic combustion fuel F3*b* is supplied to the next stage predetermined catalyst fuel nozzle 25*b*, and thereafter, the premixture combustion fuel F2*b* is supplied from the next predetermined premixture fuel nozzle 26*b*. According to the described manner, the fuel is supplied in a gradually increasing manner, thus reaching a rated point.

Figure 3:
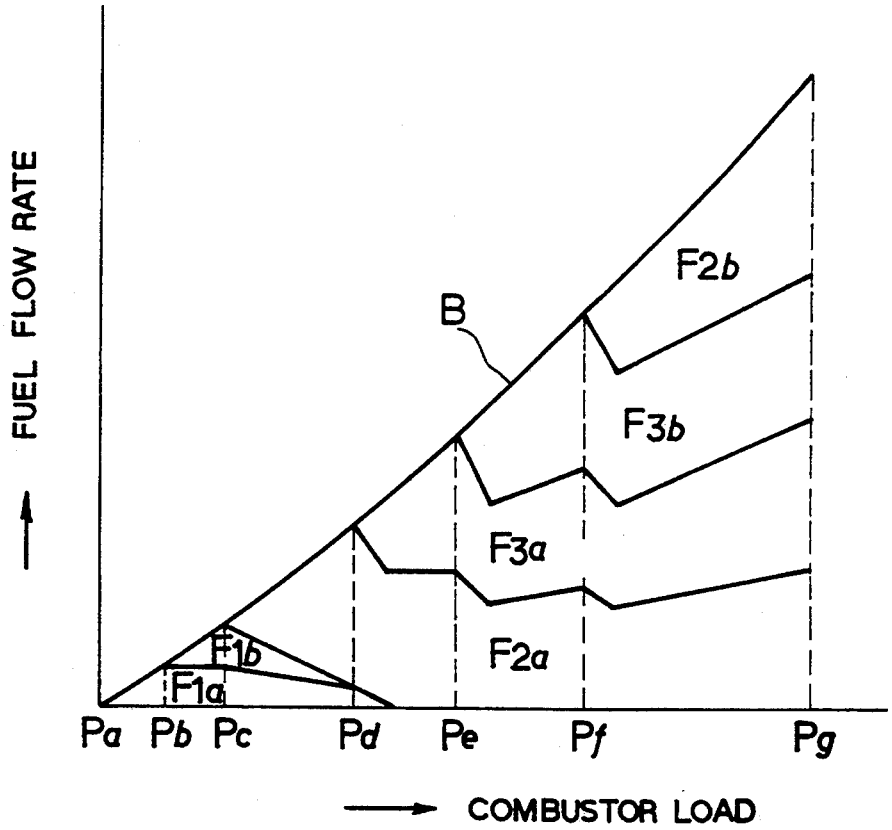
FIG. 3 is a graph of a fuel flow rate control method for the combustor of FIG. 1.

FIG. 3 is a graph representing the fuel flow rate control condition, in which the abscissa axis denotes the combustor load and the ordinate axis denotes the fuel flow rate, and a curve B represents a total fuel flow rate to be supplied to one combustor.

Referring to FIG. 3, at an ignition point Pa, the fuel F1*a* is supplied to the first diffuse fuel nozzle to ignite the fuel, at a point Pb, the fuel F1*b* is supplied to the second diffuse fuel nozzle, at a point Pc, the fuel F2*a* is supplied to the predetermined premixture fuel nozzle, at a point Pd, the fuel F3*a* is supplied to the predetermined catalyst fuel nozzle, at a point Pe, the fuel F3*b* is supplied to the next catalyst fuel nozzle, and at a point Pf, the fuel F2*b* is supplied to the next premixture fuel nozzle. The combustor load reaches a rated point at a point Pg.

Figure 4:
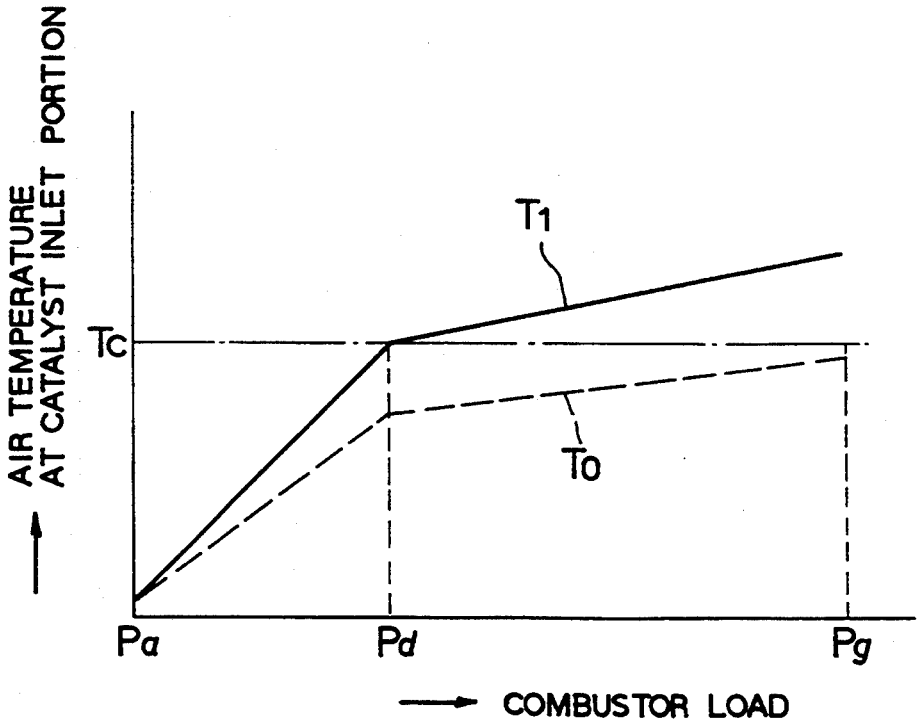
FIG. 4 is a graph showing a change of combustion air temperature.

FIG. 4 is a graph representing a relationship between the air temperature T0 drained from the compressor Cp and the air temperature T1 at the catalyst inlet portion with respect to the combustor load of a turbine combustor. As can be seen from the graph, the temperature T0 of the air drained from the compressor does not reach the catalytic combustion starting temperature Tc even if the load reaches the rated load, but the air temperature T1 at the catalyst inlet portion exceeds the catalytic combustion starting temperature Tc with the combustor load over the point Pd because this air is heated through the heat exchanging operation. Accordingly, the catalytic combustion can be carried out with the combustor load more than rated load point Pg.

In the foregoing description relating to the first embodiment, the combustion cylinder 21 is provided with three cylindrical section chambers for combustion, but the number thereof is not limited to three and at least one section chamber may be accepted in view of the heat exchanging operation for the elimination of means for heating air to be guided to the catalyst means.

Figure 5:
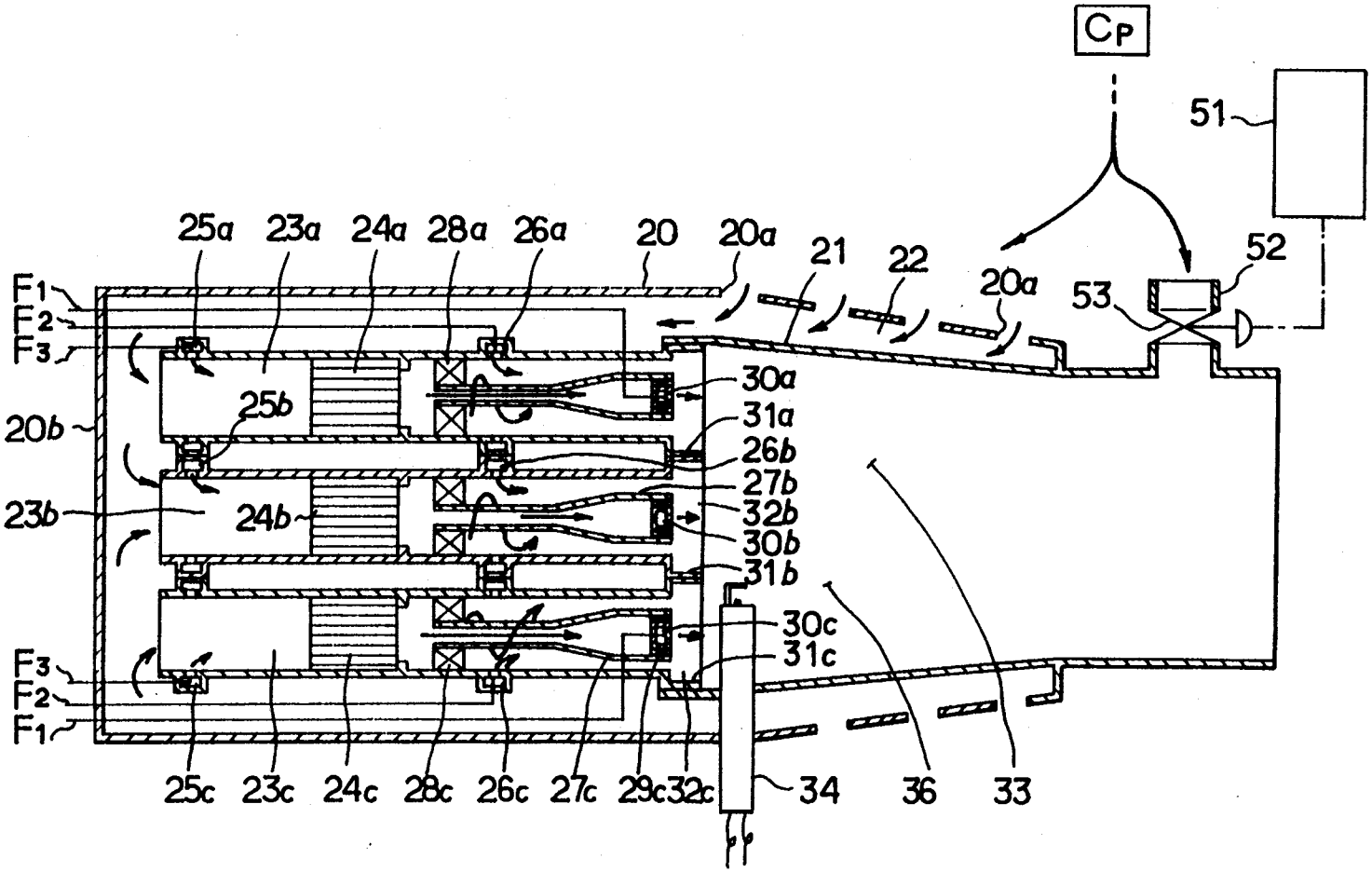
FIG. 5 is a longitudinal section showing another embodiment of a combustor for a gas turbine according to the present invention.

FIG. 5 is a schematic diagram representing a second embodiment of the present invention. Referring to FIG. 5, the combustion cylinder 21 has a front end, righthand end as viewed, in which a non-combustible air supply line 52 to brunch the air supplied from the compressor Cp into air for combustion and air for non-combustion. The air for combustion is then guided into the combustion air supply passage 22 and the air for non-combustion is guided to a portion on the downstream side of the main combustion chamber 33 through a non-combustion air supply line 52 and an air flow rate control valve 53, which is also controlled by the control means 51 described with reference to the first embodiment.

In this second embodiment, the heat exchanging means is formed by providing a plurality of openings or holes 20*a* to the outer casing 20. That is, the air for combustion from the compressor Cp is introduced into the air supply passage 22 through the openings 20*a* and forcibly collides with the outer periphery of the main combustion chamber 33 of the combustion cylinder 21. Through the colliding of the air with the outer peripheral surface of the main combustion chamber 33, the heat exchanging operation is performed therebetween and the air for combustion is heated. The heated air is guided to the inlet side end, lefthand end as viewed, of the combustion cylinder.

The other construction or structure of the second embodiment is substantially the same, as shown in FIG. 1, as that of the first embodiment represented by FIG. 1. The fuel supply and flow modes are also substantially the same as those described with reference to the first embodiment.

Figure 6:
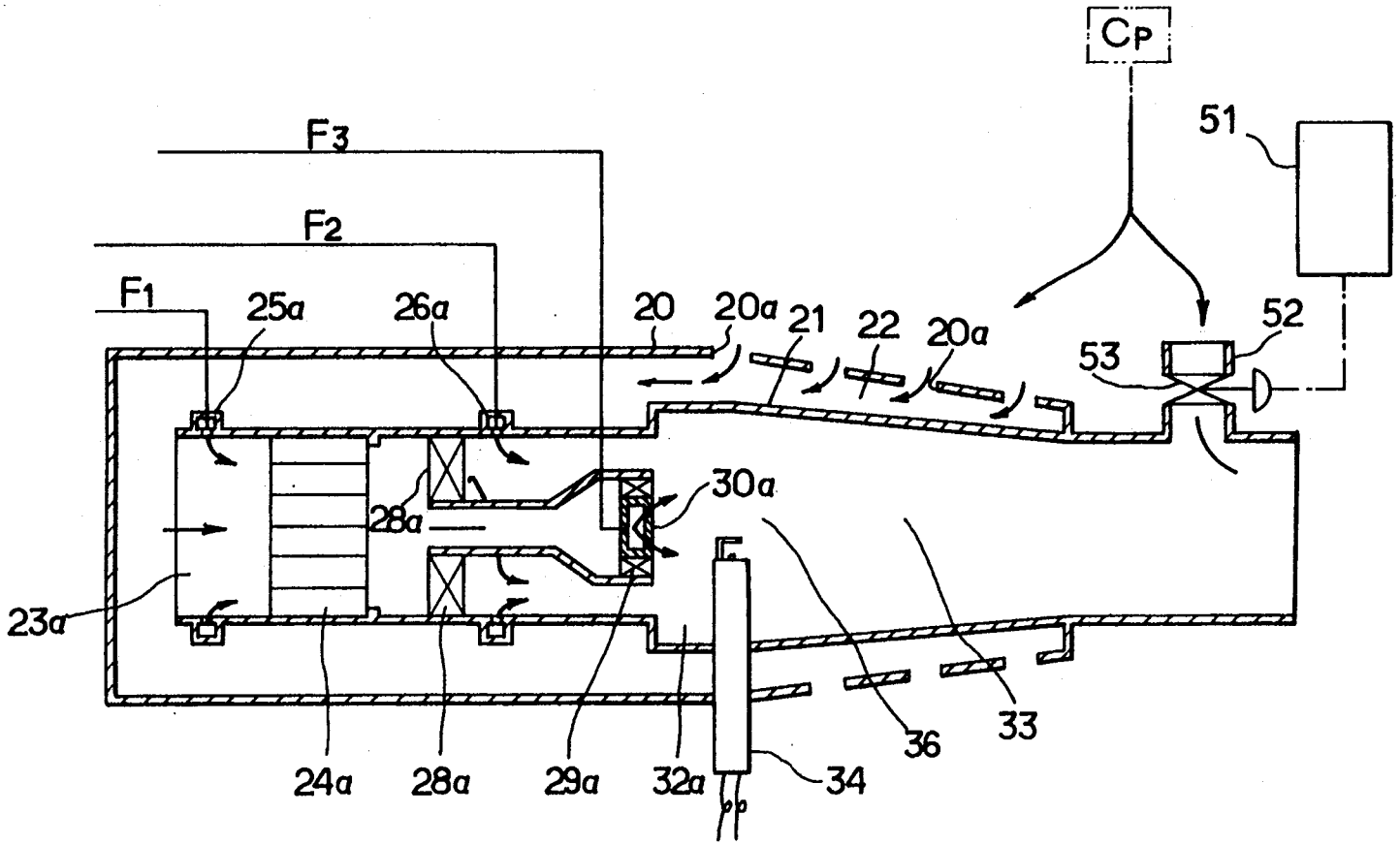
FIG. 6 is a longitudinal section of a modified embodiment of FIG. 5.

FIG. 6 is a modified embodiment of the second embodiment of FIG. 5, in which only one cylindrical combustion section chamber, corresponding to section chamber 23*a* of FIG. 1, is disposed.

In the modified second embodiment, at the time of ignition, the air flow rate control valve 53 is fully opened to supply the diffuse combustion fuel F1 to the diffuse fuel nozzle 30*a* with the supply amount of the combustion air being reduced, and in this state, the ignition plug 34 is sparked in the main combustion chamber 33. In this operation, because of the reduced amount of the air for combustion, the premixture can be carried out in a case of a reduced combustor load. When the load reaches the predetermined point, the premixture combustion fuel F2 is supplied to the premixture fuel nozzle 26a to carry out the premixture combustion, and as the combustor load increases, the premixture combustion fuel is increased in supply amount and the diffuse combustion fuel is then reduced in amount.

According to such combustion process, the air for combustion is also heated as in the first embodiment, but the combustion air is reduced in amount in the second embodiment, so that the air can be sufficiently heated with the reduced combustor load, enabling the catalytic combustion. At this point, the catalytic combustion fuel is supplied to the catalyst fuel nozzle 25a to thereby carry out the catalytic combustion.

Further, in this operation, the flow rate of the catalytic combustion fuel is controlled so that the gas temperature at the catalyst outlet portion becomes less than about 1000° C. being a heat resistant temperature of the catalyst. Since the gas temperature at the catalyst outlet portion becomes a high temperature about 900° C., the extremely stable condition of the premixture combustion can be realized at a portion at a downstream side of the catalyst outlet portion. Accordingly, the combustion state can be stably maintained even by the catalytic combustion and the premixture combustion even if the supply of the diffuse combustion fuel is completely stopped after the starting of the catalytic combustion.

Then, as the combustor load increases, the air flow rate control valve 53 is gradually closed thereby to increase the supply amount of the combustion air and also increase the premixture fuel and the catalyst fuel, thus reaching the rated load point.

Figure 7:
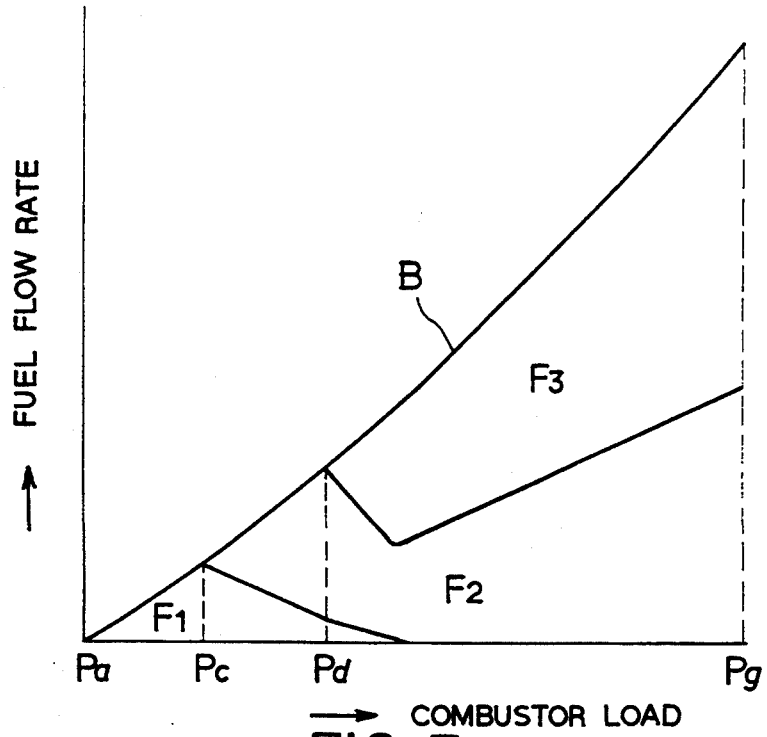
FIG. 7 is a graph of a fuel flow rate control method for the combustor of FIG. 6.

FIG. 7 is a graph, similar to that of FIG. 3, representing the fuel flow rate control condition in accordance with the second embodiment, in which the meanings of points Pa, Pc, Pd and Pg correspond to Pa, Pc, Pd and Pg of FIG. 3, respectively.

Figure 8:
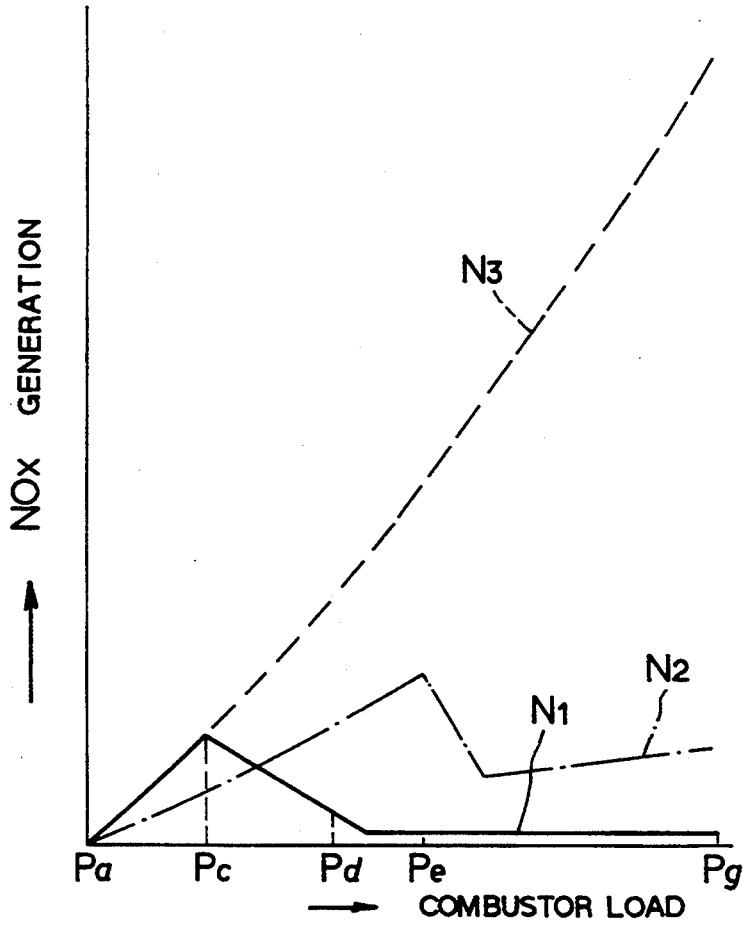
FIG. 8 is a graph showing a change of NOx generation.
Figure 9:
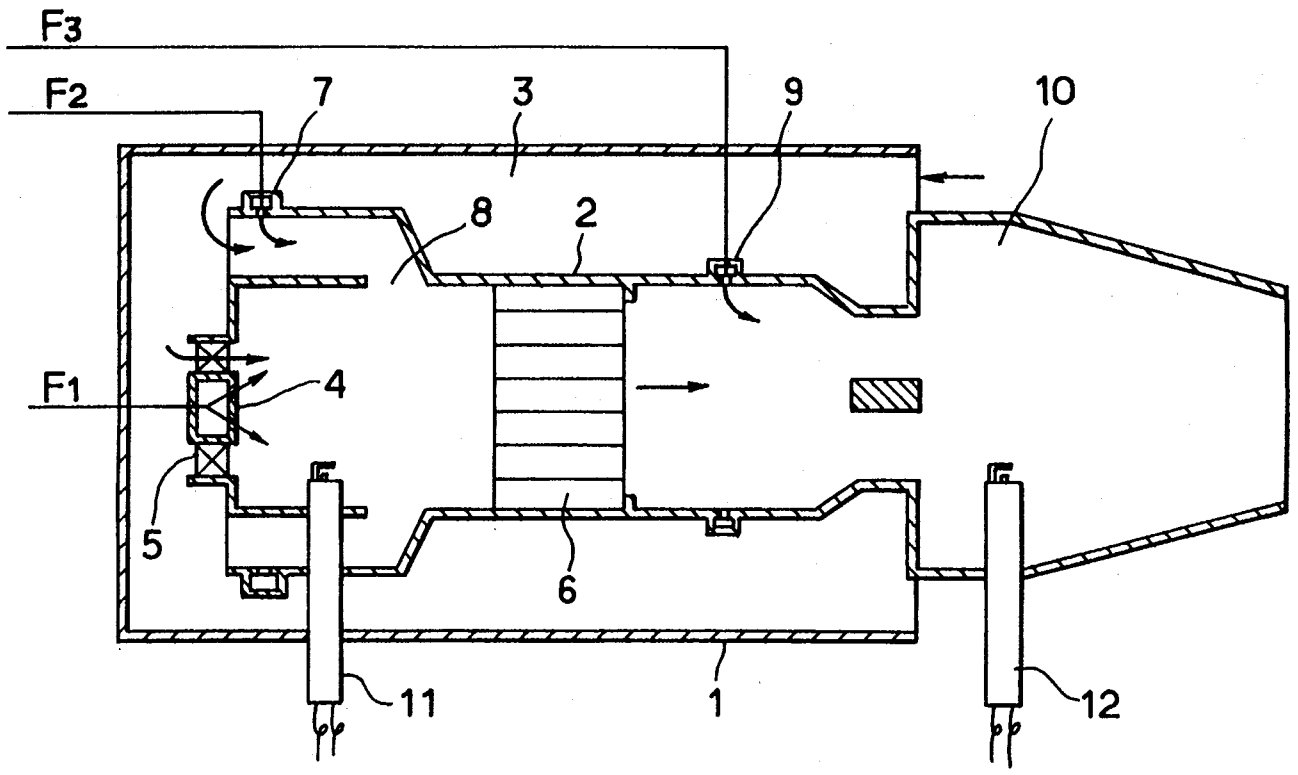
FIG. 9 PRIOR ART
FIG. 9 is a longitudinal section similar to that of FIG. 6 but showing a combustor for a gas turbine according to the prior art.
Figure 10:
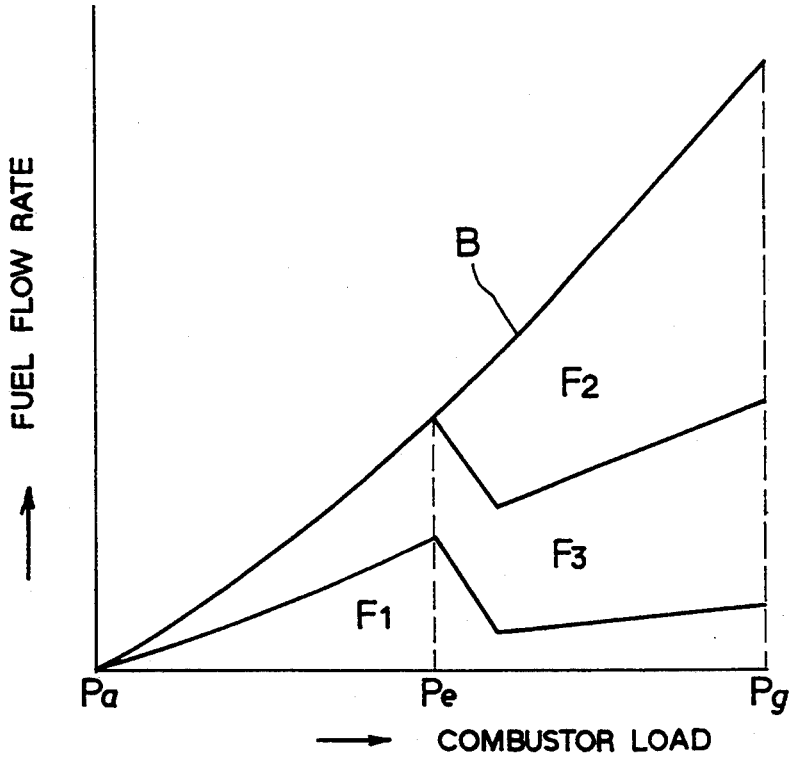
FIG. 10 is a graph of a fuel flow rate control method for the combustor of FIG. 9.
Figure 11:
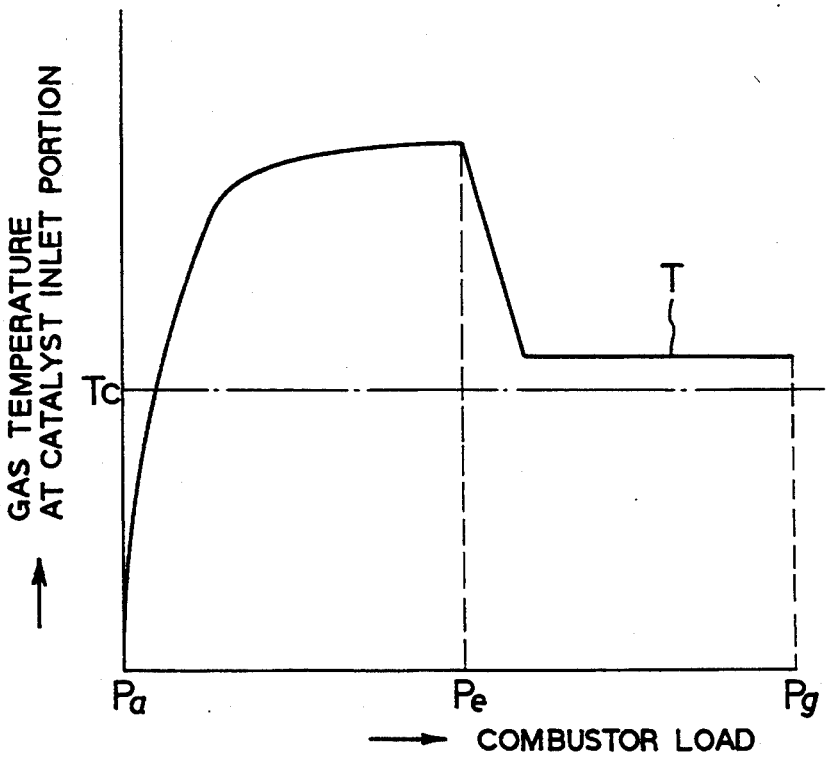
FIG. 11 is a graph showing a change of a gas temperature at a catalyst inlet portion in the combustor of the prior art.

FIG. 8 is a graph representing the relationship of the produced NOx amount with respect to the combustor load, in which a symbol N1 denotes a value according to the combustor of the present invention, a symbol N2 denotes a value according to a conventional combustor utilizing a catalytic combustion system, and a symbol N3 denotes a value according to a conventional combustor utilizing no catalytic combustion system. As can be understood from this graph, in the conventional combustor utilizing no catalytic combustion system, because the diffuse combustion is carried out at an entire load area, the diffuse combustion provides a good combustibility, but provides extremely high temperature flame, thus a large amount of NOx being produced throughout the operation in the entire combustor load area. Further, in the conventional combustor utilizing a catalytic combustion system, since the catalytic combustion is performed in a zone having a load more than a predetermined value, the generation of the NOx in this zone can be considerably reduced. However, since a portion of the fuel is diffused and burned for heating the fuel/air mixture gas to be supplied to the catalyst section or unit, it is difficult to sufficiently reduce the amount of the NOx generation.

On the other hand, according to the combustor of the present invention, the supply of the diffuse fuel can be completely stopped at the catalytic combustion load area, so that, in this catalytic combustion load area, the generation of the NOx can be substantially ignored as shown by the value of the line N1 of FIG. 8.

It is to be understood that the present invention is not limited to the described preferred embodiments and many other changes and modifications may be made without departing from the scopes of the appended claims.

What is claimed is:

1. A combustor for a gas turbine utilizing a catalytic combustion system comprising:

a cylindrical outer casing having a closed end and an opened end;

a combustion cylinder concentrically disposed inside the outer casing with an annular space between an outer periphery of the combustion cylinder and an inner periphery of the outer casing as an air supply passage for combustion air from a compressor, said combustion cylinder having a first end facing the closed end of the outer casing with a space therebetween and a second opened end projecting outward through the opened end of the outer casing, said air supply passage being communicated with the space between said closed end of the outer casing and said first end of the combustion cylinder;

a catalyst unit disposed inside the combustion cylinder, said combustion air being supplied to the catalyst unit; and a heat exchanging means formed in the air supply passage for heating the combustion air passing through the air supply passage to a temperature which is greater than a catalytic combustion starting temperature through a heat exchanging operation by a thermal energy of a combustion gas in the combustion cylinder;

wherein said heat exchanging means is formed on an outer periphery of a main combustion chamber of the combustion cylinder and an inner periphery of the outer casing as protruding members projecting from the outer and inner peripheries.

2. A combustor for a gas turbine according to claim 1, wherein said protruding members comprise fins circumferentially disposed on the outer periphery of the main combustion chamber of the combustion cylinder and the inner periphery of the casing.

3. A combustor for a gas turbine according to claim 1, wherein said combustion cylinder includes at least one chamber section for combustion and said catalyst unit is disposed in the chamber section and includes a plurality of catalyst sections disposed and sectioned in a plane normal to a flow direction of the combustion air introduced into the combustion cylinder, and wherein a fuel flow rate control means is disposed for independently controlling flow rates of fuel supplied to the respective catalyst sections in accordance with a load of the combustor.

4. A combustor according to claim 3, wherein said combustion cylinder includes a plurality of chamber sections in each of which a catalyst unit is disposed.

5. A combustor according to claim 1, wherein said combustion cylinder is provided with a plurality of diffuse combustion zones and a plurality of premixture combustion zones are formed on a downstream side of the catalyst unit with respect to the flow of the combustion air, and wherein a fuel flow rate control means is disposed for independently controlling flow rates of fuel supplied to the respective diffuse combustion zones and premixture combustion zones in accordance with a load of the combustor.

6. A combustor according to claim 5, wherein said combustion cylinder includes a plurality of chamber sections to which the diffuse combustion zones and the premixture combustion zones are respectively formed.

7. A combustor for a gas turbine utilizing a catalytic combustion system comprising:

a cylindrical outer casing having a closed end and an opened end;

a combustion cylinder concentrically disposed inside the outer casing with an annular space between an outer periphery of the combustion cylinder and an inner periphery of the outer casing as an air supply passage for combustion air from a compressor, said combustion cylinder having a first end facing the closed end of the outer casing with a space therebetween and a second opened end projecting outward through the opened end of the outer casing, said air supply passage being communicated with the space between said closed end of the outer casing and said first end of the combustion cylinder;

a catalyst unit disposed inside the combustion cylinder, said combustion air being supplied to the catalyst unit; and a heat exchanging means formed in the air supply passage for heating the combustion air passing through the air supply passage to a temperature which is greater than a catalytic combustion starting temperature through a heat exchanging operation by a thermal energy of a combustion gas in the combustion cylinder;

wherein said heat exchanging means is formed by openings formed on a cylindrical wall of the outer casing through which the combustion air is supplied in the air supply passage which collides with the an outer periphery of a main combustion chamber of the combustion cylinder.

8. A combustor for a gas turbine according to claim 7, wherein said combustion cylinder includes at least one chamber section for combustion and said catalyst unit is disposed in the chamber section and includes a plurality of catalyst sections disposed and sectioned in a plane normal to a flow direction of the combustion air introduced into the combustion cylinder, and wherein a fuel flow rate control means is disposed for independently controlling flow rates of fuel supplied to the respective catalyst sections in accordance with a load of the combustor.

9. A combustor according to claim 8, wherein said combustion cylinder includes a plurality of chamber sections in each of which a catalyst unit is disposed.

10. A combustor according to claim 7, wherein said combustion cylinder is provided with a plurality of diffuse combustion zones and a plurality of premixture combustion zones are formed on a downstream side of the catalyst unit with respect to the flow of the combustion air, and wherein a fuel flow rate control means is disposed for independently controlling flow rates of fuel supplied to the respective diffuse combustion zones and premixture combustion zones in accordance with a load of the combustor.

11. A combustor according to claim 10, wherein said combustion cylinder includes a plurality of chamber sections to which the diffuse combustion zones and the premixture combustion zones are respectively formed.

12. A combustor for a gas turbine according to claim 7, wherein an air supplied from the compressor is divided into a first air portion for combustion to be supplied to the catalyst unit through the air supply passage and a second air portion for non-combustion to be supplied into the combustion cylinder and mixed with a combustion gas at a downstream side of the main combustion chamber.

13. A combustor according to claim 12, wherein an air flow rate of the second air portion is controlled by an air flow rate control valve.

14. A combustor according to claim 13, wherein the air flow rate control valve is controlled to increase the air for combustion air in accordance with a load of the combustor.

* * * * *

UNITED STATES PATENT AND TRADEMARK OFFICE

CERTIFICATE OF CORRECTION

PATENT NO. : 5,431,017

DATED : July 11, 1995

INVENTOR(S) : Tadashi KOBAYASHI, et al.

It is certified that error appears in the above-indentified patent and that said Letters Patent is hereby corrected as shown below:

On the title page, Item [54] and Column 1, Lines 2-4, the title should read:

--CATALYST COMBUSTOR FOR GAS TURBINE SYSTEM HAVING A HEAT EXCHANGING STRUCTURE--

On the title page, Item [75], the first inventor's name should read:

--Tadashi Kobayashi--

Signed and Sealed this

Twenty-ninth Day of August, 1995

*Attest:*

BRUCE LEHMAN

*Attesting Officer*

*Commissioner of Patents and Trademarks*